US005567181A

United States Patent [19]

Lentz et al.

[11] Patent Number: 5,567,181

[45] Date of Patent: Oct. 22, 1996

[54] LOW PROFILE ELECTRICAL PLUG

[75] Inventors: Mark Lentz, Indianapolis; Steven R. Moses, Carmel; Eloy F. Pettiford, Indianapolis; Craig Stewart, Noblesville; Douglas D. Wright, Clermont, all of Ind.

[73] Assignee: Woods Industries, Inc., Carmel, Ind.

[21] Appl. No.: 436,700

[22] Filed: May 8, 1995

Related U.S. Application Data

[63] Continuation of Ser. No. 385,077, Feb. 7, 1995, which is a continuation-in-part of Ser. No. 216,920, Mar. 23, 1994, abandoned, and a continuation-in-part of Ser. No. 28,115, Sep. 7, 1994.

[51] Int. Cl.[6] ..... H01R 13/04

[52] U.S. Cl. ..... 439/694; 439/76.1

[58] Field of Search ..... 439/76.1, 77, 483, 439/484, 692, 694

[56] References Cited

U.S. PATENT DOCUMENTS

| | | | |
|---|---|---|---|
| D. 330,009 | 10/1992 | Dickie . | |
| 1,540,008 | 6/1925 | Hopkins . | |
| 1,572,563 | 2/1926 | Secretan . | |
| 1,699,722 | 1/1929 | Stott . | |
| 1,714,763 | 5/1929 | Boyson . | |
| 1,749,623 | 3/1930 | Zinman . | |
| 1,845,793 | 2/1932 | Ireland . | |
| 1,846,251 | 2/1932 | Donahue . | |
| 1,978,805 | 10/1934 | McCloy et al. . | |
| 1,984,181 | 12/1934 | French . | |
| 2,027,447 | 1/1936 | Percy . | |
| 2,030,115 | 2/1936 | Muldoon . | |
| 2,204,939 | 6/1940 | Lyons . | |
| 2,301,258 | 11/1942 | Corlew . | |
| 2,507,092 | 5/1950 | Cline . | |
| 2,542,609 | 2/1951 | Wyglendowski . | |
| 2,564,159 | 8/1951 | Greacen, Jr. . | |
| 2,855,578 | 10/1958 | Hirsch . | |
| 2,869,096 | 1/1959 | Miller . | |
| 2,894,242 | 7/1959 | Bickford et al. . | |
| 3,032,740 | 5/1962 | Hoorn . | |
| 3,391,384 | 7/1968 | Hughes | 439/76.1 |
| 3,474,376 | 10/1969 | Preiss . | |
| 3,585,565 | 6/1971 | Price et al. . | |
| 3,975,075 | 8/1976 | Mason . | |
| 3,990,766 | 11/1976 | Volinskie et al. . | |
| 4,006,958 | 2/1977 | Kramer et al. . | |
| 4,026,618 | 5/1977 | Straka . | |
| 4,771,367 | 9/1988 | Serr et al. . | |
| 4,776,814 | 10/1988 | Geurts . | |
| 4,857,013 | 8/1989 | Peters . | |
| 4,881,911 | 11/1989 | Haddock et al. | 439/484 |
| 4,927,376 | 5/1990 | Dickie . | |
| 5,034,846 | 7/1991 | Hodge et al. | 439/620 |
| 5,057,036 | 10/1991 | Dickie . | |
| 5,062,803 | 11/1991 | Howard et al. | 439/484 X |
| 5,343,007 | 8/1994 | Roeser et al. . | |

FOREIGN PATENT DOCUMENTS

| | | |
|---|---|---|
| 2634951 | 2/1990 | France . |

*Primary Examiner*—Khiem Nguyen

*Attorney, Agent, or Firm*—McAndrews, Held & Malloy, Ltd.

[57] ABSTRACT

A low profile electrical plug includes a support plate formed from a rigid, nonconductive material such as a printed circuit board. Prongs extend perpendicularly from a face of the support plate and are oriented for insertion into a conventional electrical outlet. The prongs are adapted to snap into reciprocal apertures in the support plate during assembly. Paths of electrically conductive material are disposed on a face of the support plate and extend between the prongs and terminals formed in the edge of the support plate. A power cord has electrical conductors electrically connected to different ones of the prongs to provide an electrical connection to a remote device. For this purpose, each power cord conductor includes a connector adapted slide over one of the terminals and electrically contact a respective conductive path. The integral assembly of the power cord, support plate and prongs is molded in a nonconductive housing. The prongs exit perpendicularly from a flat face on the housing and the cord exits the housing generally parallel to the flat face. A handle is connected to the housing to facilitate removal of the plug from an outlet. In one embodiment, the handle pivots away from the housing to facilitate grasping. In another embodiment, the stretchable handle is fixedly secured to the housing.

38 Claims, 4 Drawing Sheets

FIG. 1
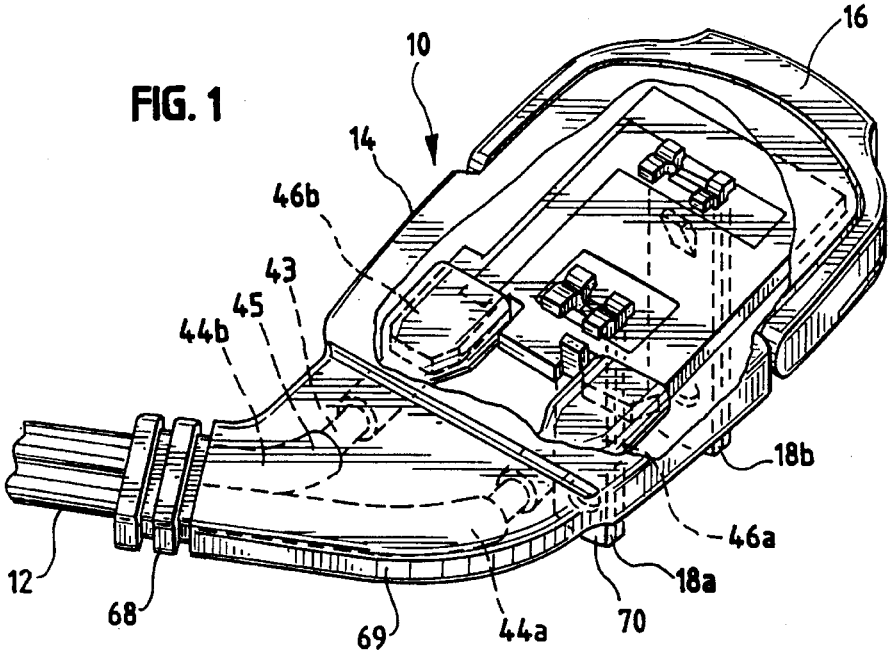
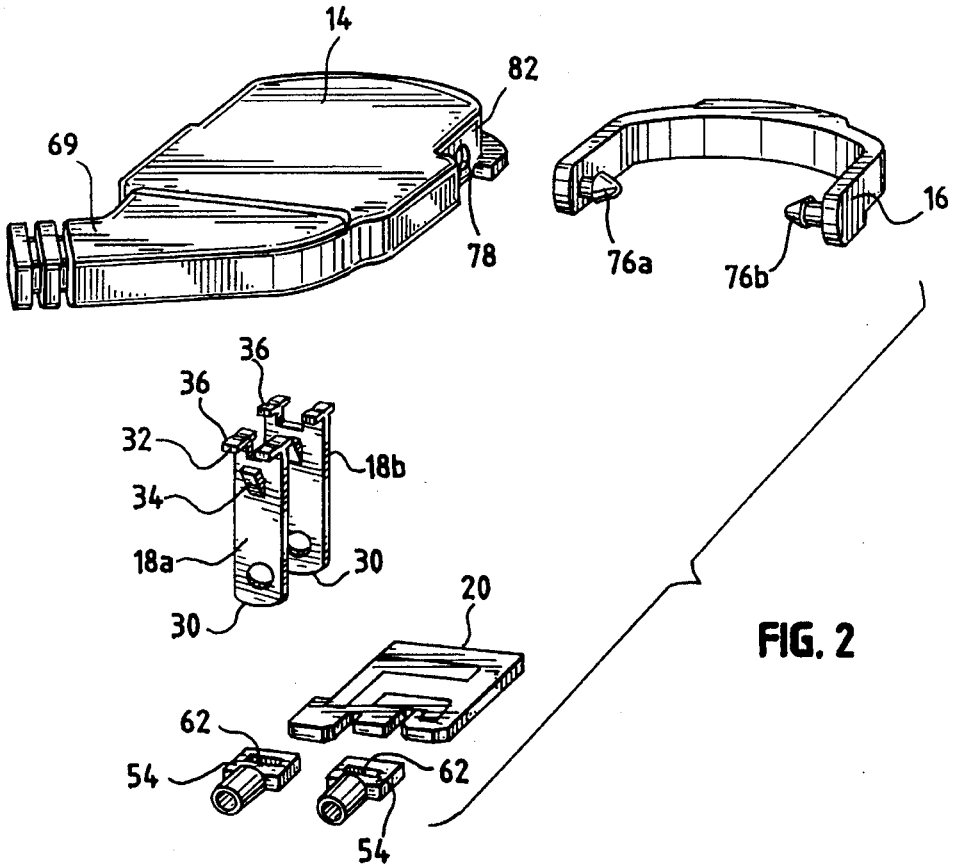
FIG. 2

FIG. 4
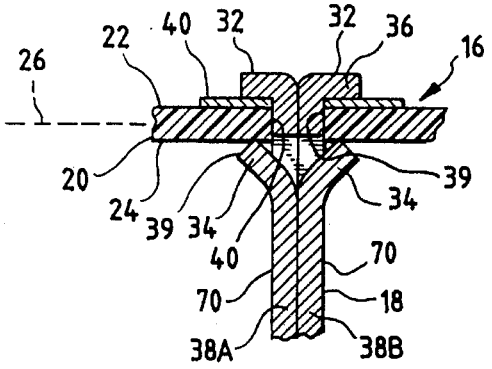
FIG. 3
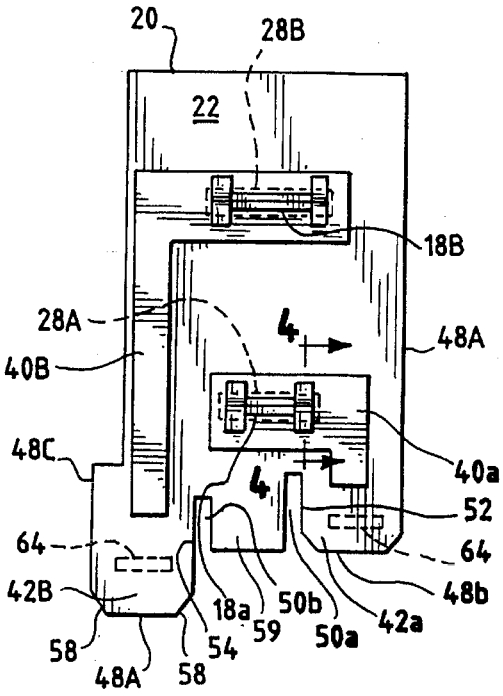
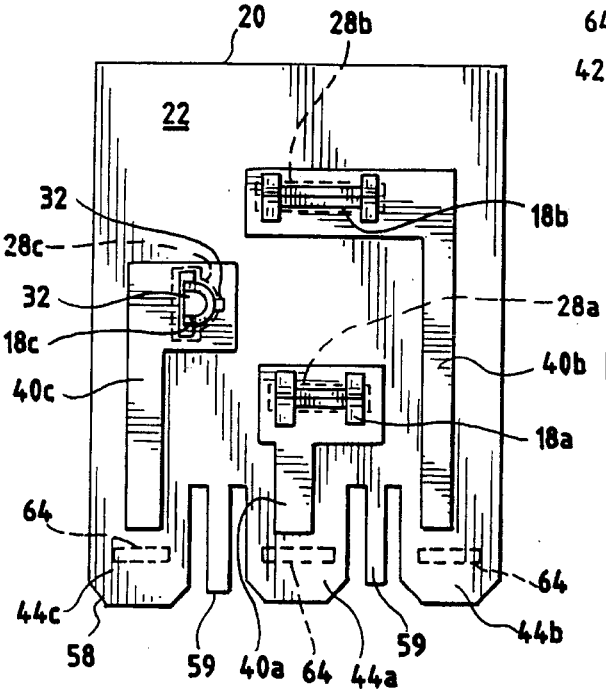
FIG. 5
FIG. 6
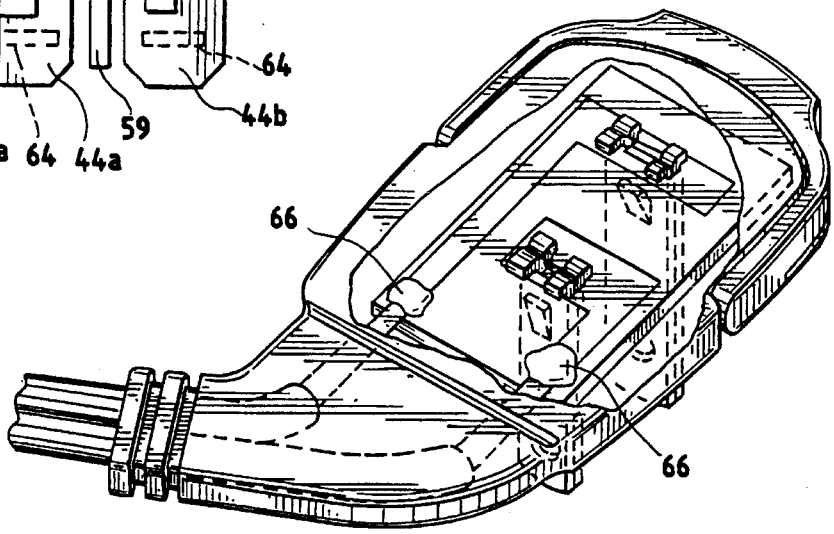

FIG. 7
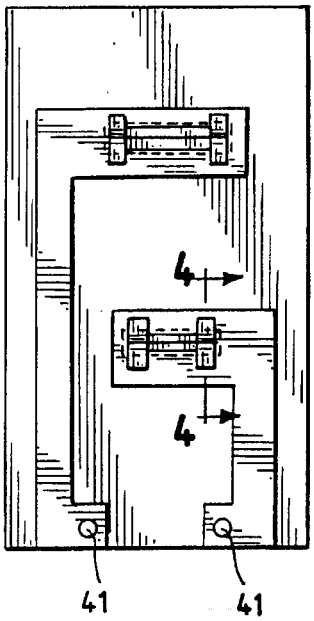
FIG. 8
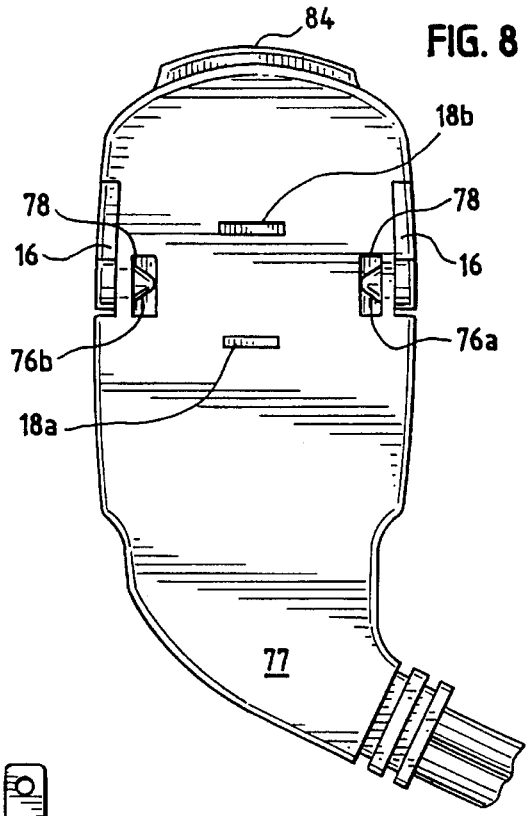
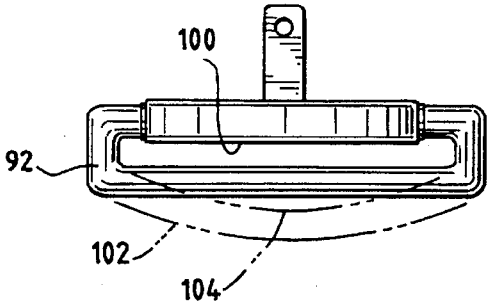
FIG. 11
FIG. 10
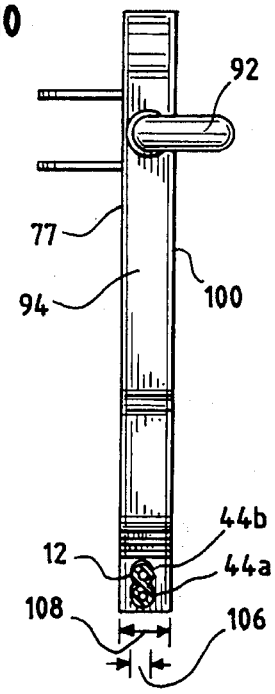
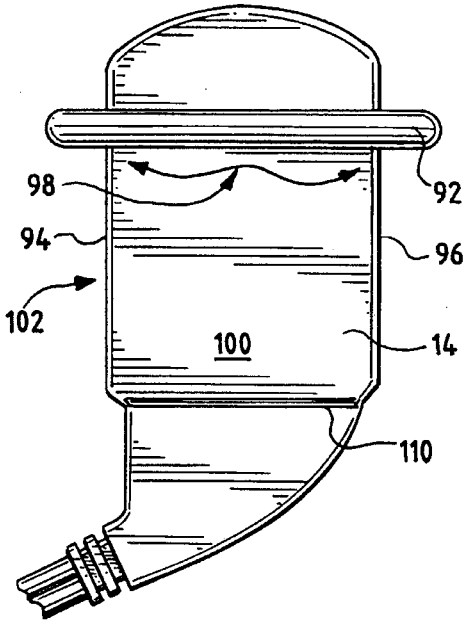
FIG. 9

FIG. 12
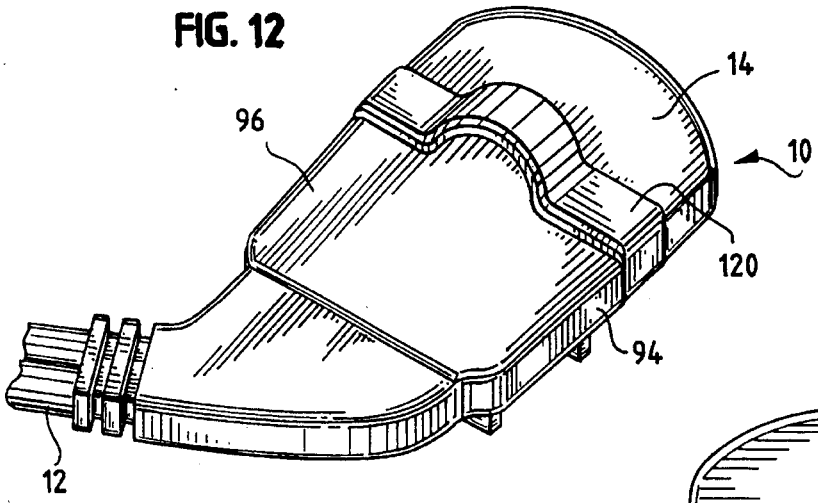
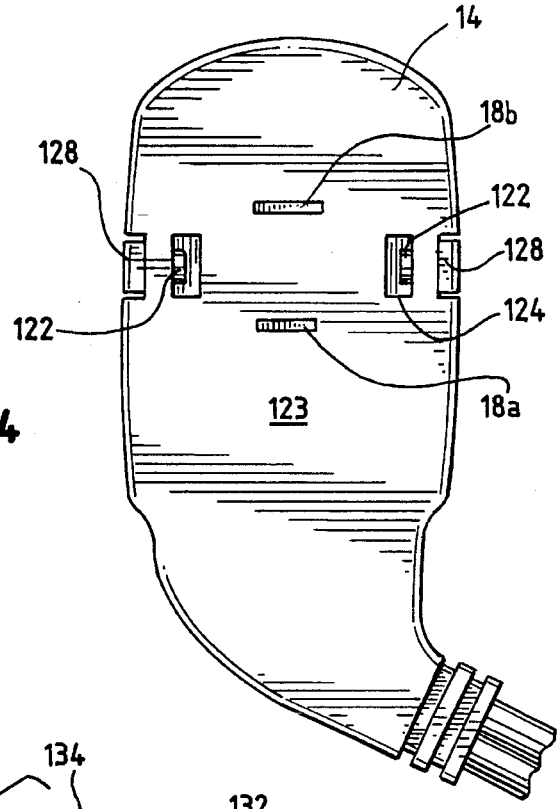
FIG. 14
FIG. 13
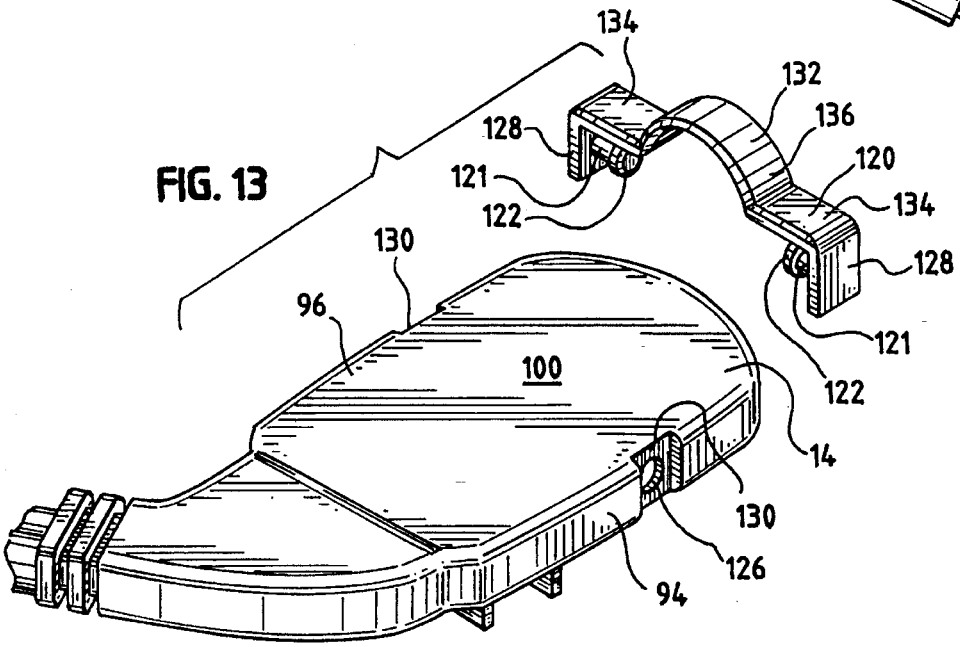

LOW PROFILE ELECTRICAL PLUG

CROSS-REFERENCE TO RELATED APPLICATIONS

This is a continuation of application Ser. No. 08/385,077, filed Feb. 7, 1995, which is a continuation-in-part of application Ser. No. 08/216,920, filed Mar. 23, 1994 (now abandoned); and a continuation-in-part of application Ser. No. 29/028,115, filed Sep. 7, 1994.

FIELD OF THE INVENTION

The present invention relates generally to an electrical plug and, more particularly, to an electrical plug having a low profile.

BACKGROUND OF THE INVENTION

Conventional electrical plugs are undesirable in certain environments because their housings typically protrude a substantial distance from the wall once the plug is inserted into an outlet. A protruding plug is susceptible to unintentional disengagement by moving objects, and may prevent furniture or other objects from being placed close to the wall.

Over the years a variety of plugs have been developed which have low profile housings (hereinafter referred to as "low profile plugs"). However, known low profile plugs are problematic because their prongs are not adequately supported in the housing. As a result, the prongs can be torn from the housing when the plug is removed from the outlet. In addition, low profile plugs are costly and time consuming to manufacture because of the difficulty in maintaining the proper orientation of the prongs during the molding process.

The present invention is directed to overcoming these and other problems.

More specifically, an object of the present invention is to provide an electrical plug which minimizes plug protrusion when the plug is inserted into an electrical outlet.

It is another object of the present invention to provide a low profile plug which is economical and simple to manufacture.

It is yet another object of the present invention to provide a low profile electrical plug which can incorporate either two electrical prongs or three electrical prongs without substantial design or manufacturing set-up changes.

Other objects and advantages of the invention will become apparent upon reading the following detailed description and appended claims, and upon reference to the accompanying drawings.

SUMMARY OF THE INVENTION

In accordance with one aspect of the present invention a low profile electrical plug comprises a planar support plate formed from a nonconductive material. At least two electrically conductive prongs are secured to and extend from the support plate. Electrically conductive traces are disposed on a face of the support plate, and each conductive trace is in electrical contact with a different one of the conductive prongs. A nonconductive housing encases the support plate such that the prongs extend perpendicularly from the bottom of the housing. A power cord exits the side of the housing and has electrical conductors which are in electrical connection with the conductive traces.

BRIEF DESCRIPTION OF THE DRAWINGS

For a more complete understanding of this invention reference should now be had to the embodiment illustrated in greater detail in the accompanying drawings and described below by way of example of the invention.

In the drawings:

FIG. 1 is a sectional top perspective view of an embodiment of a low profile electric plug and cord;

FIG. 2 is an exploded perspective view of the electric plug of FIG. 1;

FIG. 3 is a top view of a support plate of the electric plug of FIG. 1;

FIG. 4 is a sectional side view of FIG. 3 along line 4—4, showing the interface between the support plate and a prong;

FIG. 5 is a top view of a support plate for a three-prong low profile plug;

FIG. 6 is a sectional top perspective view of an alternate embodiment of a low profile electric plug and cord;

FIG. 7 is a top view of a support plate of the electric plug of FIG. 6;

FIG. 8 is a bottom view of the plug and cord of FIG. 1;

FIG. 9 is a top view of an alternate embodiment of a low profile electric plug;

FIG. 10 is a side view of the electric plug of FIG. 9;

FIG. 11 is an end view of the electric plug of FIG. 9;

FIG. 12 is a perspective view of an alternate embodiment of a low profile electric plug;

FIG. 13 is a perspective view of the electrical plug of FIG. 12 showing the handle removed from the plug housing; and FIG. 14 is a bottom view of the electric plug of FIG. 12.

DETAILED DESCRIPTION OF THE PREFERRED EMBODIMENTS

In the following detailed description, spatially orienting terms are used such as "left," "right," "vertical," "horizontal," the like. It is to be understood that these terms are used for convenience of description of the preferred embodiments by reference to the drawings. These terms do not necessarily describe the absolute location in space, such as left, right, upward, downward, etc., that any part must assume.

Referring now to FIGS. 1 and 2, a low profile electrical plug 10 is connected to the end of a power cord 12. Plug 10 is formed of a molded housing 14, a pull-out handle 16 and a pair of electrical prongs **18*a*, 18*b*. Housing 14** is molded from a nonconductive material such as polyvinylchloride (PVC).

In a two-prong plug as shown in FIGS. 1–4, plug 10 includes a live prong **18*a* and a neutral prong 18*b*. Plug 10 may be polarized by making neutral prong 18*b* wider than live prong 18*a*. In a three-prong plug (not shown), the plug 10 would include an additional grounding prong 18*c* (FIG. 5**).

Prongs **18*a*, 18*b* are supported in housing 14 by a support plate 20 formed of a rigid, nonconductive material. Preferably, support plate 20 is made from a conventional printed circuit board (PCB) material. Support plate 20 is in the form of a thin sheet, generally rectangular in shape as shown in FIG. 3. Support plate 20 has a top flat face 22 and a bottom flat face 24, as shown in FIG.4. Faces 22, 24 are disposed parallel to one another and support plate 20 generally defines a central plane 26**.

Referring to FIG. 3, prong receiving apertures 28*a*, 28*b* are formed in support plate 20 and extend between the top and bottom faces 22, 24. For a two-prong plug, as shown in FIGS. 1–4, aperture 28*a* serves as a live prong aperture and aperture 28*b* serves as a neutral prong aperture. For a three-prong plug, an additional ground prong aperture 28*c* (FIG. 5) is provided in support plate 20.

During assembly of plug 10, prongs 18*a*, 18*b*, 18*c* are slid into prong receiving apertures 28*a*, 28*b*, 28*c*, via distal end 30 first. Prongs 18 are located and locked into place by tabs 32, 34 formed in the proximate end 36 of each prong.

As shown in FIG. 4, each prong 18*a*, 18*b*, 18*c* includes at least one stop tab 32 and at least one locking tab 34. Stop tabs 32 are formed from the proximate end 36 of each prong 18. Prongs 18*a*, 18*b* may be formed from two side by side pieces of stamped metal 38*a*, 38*b*. Stop tabs 32 are formed from bending the ends 36 perpendicularly from the longitudinal axis of a respective prong 18. Stop tabs 32 serve to limit the distance that the prong 18 is inserted into the support plate 20.

Locking tabs 34 are space apart from, and located below, stop tabs 32 by a distance which is approximately equal to the thickness of support plate 20. Locking tabs 34 are cut and bent out from stamped metal 38*a*, 38*b*. Locking tabs 34 are normally biased outwardly from the prong 18 and are compressible inwardly to allow prong 18 to slide into a prong receiving aperture 28. Once the top ends 39 of the locking tabs 34 pass through the prong receiving aperture 28, the locking tabs 34 snap outwardly so as to lock prong 18 securely onto support plate 20. For added strength and stability prongs 18 may be soldered to support plate 20.

Referring again to FIG. 3, paths or traces 40*a*, 40*b* of electrically conductive material such as copper are disposed on one face 22 of support plate 20. Traces 40*a*, 40*b* extend between prong receiving apertures 28*a*, 28*b*, and a pair of terminals 42*a*, 42*b* formed along an edge of support plate 20. The two-prong plug 10 includes a live trace 40*a* and a neutral trace 40*b*, whereas the three-prong plug additionally includes a ground trace 40*c* (FIG. 5). Preferably, the conductive traces 40 are screen printed onto the top face 22 of support plate 20; however, it is foreseeable to form the conductive traces 40 using methods such as etching, insertion molding or compression molding. Each conductive trace 40 extends around the perimeter a respective prong receiving aperture 28, as shown in FIG. 4, to provide a good electrical connection to the prongs 18 when prongs 18 are inserted into the support plate apertures. Thus, support plate 20 is a printed circuit board. Traces 40 are preprinted onto support plate 20 to form a subassembly of support plate 20 and traces 40.

Referring again to FIG. 1, power cord 50 includes a pair of electrical conductors 44*a*, 44*b*. Each conductor 44*a*, 44*b* is formed from a conductive core 43 and an outer casing 45. A pair of connectors 46*a*, 46*b* are adapted to slide onto terminals 42*a*, 42*b* respectively and electrically contact conductive traces 40*a*, 40*b* to complete an electrical connection between prongs 18*a*, 18*b* and power cord 12, and to a remote device (not shown) connected to the far end (not shown) of cord 12.

In the two-prong plug, power cord 50 has a live conductor 44*a* and a neutral conductor 44*b*. In the three-prong conductor, power cord 50 additionally includes a ground conductor (not shown).

Each connector 46 is configured to slide over a respective terminal 42 and to electrically contact a respective one of the conductive traces 40. Terminals 42 are formed from a portion of support plate 20. Terminal 42*a* is formed in the corner of support plate 20 from one side 48*a* and another side 48*b* of the support plate. A side 50*a* is formed in the support plate to provide a third side 52 to terminal 42*a*. Beveled edges 58 are provided to facilitate insertion of connectors 46 onto terminals 42 during assembly.

Likewise, terminal 42*b* is formed from sides 48*c*, 48*d* of the support plate. A slot 50*b* provides side 54 to terminal 42*b*.

Sections 59 (FIGS. 3 and 5) of support plate 20 extends between terminals 42*a*, 42*b* to prevent connectors 46*a*, 46*b* from contacting each other when they are positioned onto terminals 42.

In the drawings, connectors 46 and terminals 42 are shown to be uniform in size and shape; however, their size and shape can be varied to ensure that the connectors 46 are placed onto the correct terminals 42 during assembly. For example, one connector 46*a* is of a size for only fitting onto terminal 42*a*, and the other connector 46*b* is of a size for only fitting onto terminal 42*b*, and not 42*a*.

Additionally, a structure can be provided for releasably locking the connectors 46 onto the terminals 42. For example, connectors 46 can include optional protrusions 62 (FIG. 2) adapted to engage reciprocal locking grooves 64 (FIG. 3) formed in terminals 42.

As will be appreciated, other methods can be used to connect the power cord conductors 44 to the conductive traces 40. For example, conductors 44 may be soldered directly onto support plate 20, as is illustrated in FIG. 6 by solder 66. In such an embodiment, it is not necessary to form the terminals 42 in support plate 20, as shown in FIG. 7. An aperture 41 may pass through the support plate for receiving a conductor 44 prior to soldering.

After prongs 18 and power cord 12 are secured to support plate 20, housing 14 is injection molded around the subassembly of support plate 20, traces 40, prongs 18, connectors 46 and conductors 44. Housing 14 includes a strain relief portion 68 which is molded around power cord conductors 44.

Housing 14 includes a tapered portion 69 which maintains a desired orientation of the power cord 12 and adds structural support at the junction of power cord 12 and housing 14.

In the illustrated embodiment, power cord conductors 44 leave support plate 20 in the same plane 26 as support plate 20 and in a direction perpendicular to flat side faces 70 of prongs 18. Tapered portion 69 is angled such that power cord conductors 44 ultimately exit housing 14 in a direction that forms an angle other than 90° with respect to the faces 70 of flat prongs 18. Hence, when plug 10 is inserted in a standard wall-mounted outlet having two sets of vertical side-by-side contact slots, cord 12 extends downwardly from the outlet but it does not overlay the other contact slots in a lower outlet.

A handle 72 is attached to housing 14 to facilitate removal of plug 10 from an outlet. Preferably, handle 72 is a separately molded piece and is mechanically hinged at its point of connection to housing 14. Handle 72 is rotatable to a convenient angle to permit the user to pull on the handle in order to pull prongs 18 out of the wall outlet. For this purpose, handle 72 includes a pair of nipples 76*a*, 76*b* which are adapted to snap into reciprocal apertures 78 (FIG. 8) formed in housing 14. Alternatively, handle 72 can be integrally formed with housing 14, providing a fixed handle to be gripped for removal of the plug.

When not in use, handle 72 fits flush against a recess 82 in housing 14, as is illustrated in FIG. 1. Handle 72 includes a projecting lip 84 (FIG. 8) which overhangs the front edge of housing 14. The lip can be engaged by the fingers and used to rotate the handle to a point to facilitate removal of plug 10 from an outlet.

Referring to FIG. 9 a different type of handle 92 may be utilized to remove the flat plug 10 from a conventional electrical wall outlet. As shown in FIGS. 9, 10, and 11, handle 92 is secured to each lateral side 94, 96 of housing 14. Handle 92 is generally cylindrical in shape and has a diameter substantially equal to the thickness of the housing 14, as best seen in FIG. 11. Handle 92 extends outwardly laterally and returns inwardly laterally in a U-shape configuration from the sides of housing 14 and provides a continuous cylindrical central portion along the top of the plug as indicated at 98. Handle 92 is formed from a flexible material, e.g., plastic or rubber, so that central portion 98 flexes outwardly from the top surface 100 of housing 14, as shown in FIG. 11 by the dashed lines 102, 104. The operator or user grips handle 92 and flexes the handle so as to provide an area between the handle and the top of the housing to facilitate gripping of the handle and its pulling to remove the plug from a conventional electrical outlet.

As shown in FIG. 11, the central portion 98 is spaced slightly above the top surface 100 of the housing and in a plane parallel to the plane of housing 14. Handle 92 may be integrally molded, bonded, welded, glued or otherwise fixed rigidly to housing 14.

As shown in FIG. 10, the power cord 12 is approximately ⅛ inch thick, the distance 106, and housing 14 is approximately 5/16 of an inch thick, the distance 108. Thus, the housing 14 is approximately 2 ½ times thicker than power cord 12. As will suggest itself, power cord 12 may be turned 90° and may be of substantially the same thickness as housing 14.

As shown in FIG. 9, a shallow design line 110 is scribed or molded in the top casing and merely serves as an ornamental line. The top of casing 14 is flat as shown in FIG. 10. Space is left above line 110 for placement of a trademark.

The prongs 18 extend perpendicularly from the flat bottom face 77 (FIGS. 8 and 10) of the housing and are spaced and oriented for insertion into a conventional wall outlet (not shown).

FIGS. 12–14 illustrate yet another type of handle 120 which may be utilized to remove the flat plug 10 from an electrical outlet. Handle 120 is fixedly secured to each lateral side 94, 96 of housing 14. Specifically, handle 120 is a separately molded piece and is mechanically connected to housing 14 by a pair of pins 121 which terminate in raised heads 122 sized to snap into reciprocal apertures 126 (one shown) formed in the lateral sides 94, 96 of housing 14. (See FIG. 13).

Handle 120 has downwardly extending side legs 128 which carry the pins 121 and which are sized fit into recessed notches 130 formed in housing 14 around the apertures 126, thereby preventing rotation of handle 120 relative to housing 14. Side legs 128 have a thickness approximately equal to the depth of recesses 130 so that the outer edges of side legs 120 are flush with the edge of housing 14. (See, e.g. FIG. 14).

Handle 120 includes a transverse leg 132 extending across the top face 100 of housing 14 between the handle side legs 128. Transverse leg 132 includes an arcuate portion 136 positioned between two flat portions 134. Arcuate portion 126 curves away from the face 100 of housing 14 to facilitate gripping of handle 120 and its pulling to remove the plug 10 from a conventional electrical outlet. Handle 14 has a generally rectangular cross-section of a uniform thickness and is formed from a flexible material. A suitable material for forming the handle is a polyurethane such as Elastollan, #P85A, Hardness: 37 Shore D as manufactured by BASS.

The assembly process of plug 10 is now briefly described. Initially, the various components are prepared for assembly. More specifically, support plate 20 is machined to desired shape, including formation of terminals 42 and prong receiving apertures 28. Conductive traces 40 are then disposed on the top face 22 of support plate 20. This provides a first subassembly. Next, prongs 18 are snapped into place and soldered to support plate 20. Connectors 54 from power cord conductors 46 are then slid onto the terminals 44. Alternatively, power cord conductors 46 can be soldered directly to support plate 20. This provides a second subassembly. Housing 14 is then injection molded around the integral support plate assembly which is the second subassembly. Support plate 20 ensures that the proper prong orientation is maintained during the injection molding process and during use of plug 10. The rigidness of support plate 24 also adds to the structural integrity of plug 10 and reduces the likelihood of prongs 18 being torn from molded housing 14 when plug 10 is removed from an outlet. Finally, the separately molded handle 72 (or 120) is attached to housing 14. If handle 92 is used, it is attached after or during the injection molding depending on the type of attachment.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A low profile electrical plug and power cord for mating with a conventional electrical outlet, comprising:

a planar support plate having a low profile;

at least two electrically conductive outlet prongs rigidly secured to said support plate and extending perpendicularly therefrom;

a first path of electrically conductive material disposed on said support plate and being in electrical contact with one of said conductive prongs;

a second path of electrically conductive material disposed on said support plate and being in electrical contact with the other of said conductive prongs;

a power cord having at least a first conductor and a second conductor, said first conductor being in electrical contact with said first path of electrical conductive material and said second conductor being in electrical contact with said second path of electrical conductive material;

a non-conductive housing encasing said planar support plate and a portion of said power cord, said housing including a bottom surface through which said prongs extend a sufficient distance for engagement into an electrical outlet.

2. A low profile electrical plug and power cord as set forth in claim 1, further comprising a handle secured to said housing, said handle being stretchable to facilitate grasping thereof.

3. A low profile electrical plug and power cord as set forth in claim 2, wherein said handle includes a central portion shaped of a longitudinal band and being disposed adjacent said housing.

4. A low profile electrical plug and power cord as set forth in claim 3, wherein said central portion has a uniform cross section along its longitudinal length.

5. A low profile electrical plug and power cord as set forth in claim 4, wherein said cross section is circular in shape.

6. A low profile electrical plug and power cord as set forth in claim 3 wherein said housing has a top side and two lateral sides; and wherein said handle is secured to the two lateral sides of said housing and said central portion is disposed adjacent said top side of said housing.

7. A low profile electrical plug and power cord as set forth in claim 3, wherein said handle is fixed against rotation relative to said housing.

8. A low profile electrical plug and power cord as set forth in claim 1, further comprising a handle rotatably attached to said housing to permit grasping thereof to facilitate removal of the plug from an electrical outlet.

9. A low profile electrical plug and power cord as set forth in claim 8, wherein said handle is mechanically hinged at its point of connection to the housing.

10. A low profile electrical plug and power cord as set forth in claim 9, wherein said handle includes nipples; and wherein said housing includes reciprocal apertures adapted to receive said nipples so as to secure said handle to said housing.

11. A low profile electrical plug and power cord as set forth in claim 1, wherein said power cord exits said housing in the same general plane as the plane defining said support plate.

12. A low profile electrical plug and power cord as set forth in claim 1, wherein said housing is of substantially the same thickness as said power cord.

13. A low profile electrical plug and power cord as set forth in claim 1, wherein said housing is molded around said support plate.

14. A low profile electrical plug and power cord as set forth in claim 1, wherein said prongs and said power cord are arranged such that said cord is directed at a non-vertical angle to the plane of a wall outlet upon insertion into the wall outlet, the wall outlet having vertical side-by-side contact slots.

15. A low profile electrical plug and power cord as set forth in claim 1, wherein said support plate is a printed circuit board.

16. A low profile electrical plug and power cord as set forth in claim 15, wherein said conductive paths are screen printed on to said plate forming said printed circuit board.

17. A low profile electrical plug and power cord as set forth in claim 1, wherein:

said support plate includes terminals integrally formed in an edge of said support plate; and further comprising:

first and second connectors attached to respective ends of said first and second conductors, each said connector being adapted to mate with one of said terminals.

18. A low profile electrical plug and power cord as set forth in claim 17, wherein said connectors snap onto said terminals.

19. A low profile electrical plug and power cord as set forth in claim 1, wherein said housing includes a strain relief formed around a portion of said power cord.

20. A low profile electrical plug and power cord as set forth in claim 1, wherein:

said planar support plate has an upper surface, a lower surface, and first and second prong receiving apertures extending between said upper and lower surfaces; and wherein:

said first and second electrically conductive outlet prongs are rigidly secured to said support plate through said first and second prong receiving apertures, respectively.

21. A low profile electrical plug and power cord as set forth in claim 20, wherein said prongs are adapted to snap into the apertures during assembly.

22. A low profile electrical plug and power cord as set forth in claim 21, wherein said prongs include retention tabs which lock said prongs into the prong receiving apertures.

23. A low profile electrical plug and power cord as set forth in claim 1, further comprising a handle fixedly secured to said housing, said handle including an arcuate portion curving away from said housing to facilitate grasping of said handle.

24. A low profile electrical plug and power cord as set forth in claim 23, wherein said handle is stretchable.

25. A low profile electrical plug and power cord as set forth in claim 23, wherein said housing has a top side and two lateral sides; and wherein said handle is secured to the two lateral sides of said housing and said arcuate portion is disposed adjacent said top side of said housing.

26. A low profile electrical plug and power cord as set forth in claim 23, wherein said handle includes nipples; and said housing includes reciprocal apertures adapted to receive said nipples so as to secure said handle to said housing.

27. A low profile electrical plug and power cord, comprising:

a support plate formed from a nonconductive material and having opposing flat faces, said support plate having first and second terminals integrally formed at an edge of said support plate;

first and second electrically conductive prongs rigidly secured to and extending perpendicularly from one of said faces of said support plate;

first and second paths of electrically conductive material disposed on at least one face of said support plate, each conductive path being in electrical contact with a respective one of said first and second prongs and extending across at least a portion of a respective one of the first and second terminals;

a power cord having first and second electrical conductors, each said electrical conductor including a connector adapted to mate with a respective terminal and to electrically contact a respective one of said conductive paths;

a nonconductive housing encasing said support plate and the connectors of said power cord conductors, said housing having a bottom face, said prongs extending perpendicularly from said bottom face.

28. A low profile electrical plug and power cord as set forth in claim 27, wherein said power cord exits said housing in the same plane as said support plate.

29. A low profile electrical plug and power cord as set forth in claim 27, wherein said housing is of substantially the same thickness as said power cord.

30. A low profile electrical plug and power cord as set forth in claim 27, further comprising a handle rotatably attached to said housing for movement to permit grasping thereof to facilitate removal of the plug from an electrical outlet.

31. A low profile electrical plug and power cord as set forth in claim 27, wherein said support plate is a printed circuit board.

32. A low profile electrical plug and power cord as set forth in claim 27, wherein said support plate includes first and second prong receiving apertures extending between said faces of said support plate; and wherein said prongs are adapted to snap into said apertures during assembly of said plug.

33. A low profile electrical plug and power cord as set forth in claim 27, further comprising a stretchable handle fixedly secured to said housing.

34. A low profile electrical plug and power cord as set forth in claim 33, wherein said handle includes an arcuate portion curving away from said housing to facilitate grasping of said handle.

35. An improved low profile electrical plug for use with a power cord, the low profile plug being of the type including a housing having a top face, a bottom face, a side wall extending between the top and bottom faces, at least two electrically conductive prongs extending from the bottom face of the plug and being oriented for insertion into a conventional electrical outlet, the power cord extending from the housing and having conductors electrically connected to receive electrical power from the conductive prongs, the improvement comprising:

a handle secured to said housing and fixed against rotation relative to said housing, said handle including a transverse leg extending across the top face of the housing between opposite edges of the housing side wall, the transverse leg including an arcuate portion positioned between two flat portions, the arcuate portion curving away from the top face of said housing to facilitate grasping of said handle.

36. An improved low profile electrical plug for use with power cord, the electrical plug being of the type having at least two electrical prongs extending therefrom and being oriented for insertion into a conventional electrical outlet, the power cord extending from the housing and having conductors electrically connected to receive electrical power from the conductive prongs, the improvement comprising:

a stretchable handle secured to said housing to facilitate removal of said plug from an outlet, said handle being fixed against rotation relative to said housing and having an upstanding portion which extends above and away from the top face of the housing to facilitate grasping of the handle.

37. An improved electrical plug as set forth in claim 36, wherein said housing has a top side, a bottom side and two lateral sides, said prongs extending from said bottom side; and wherein said handle is secured to the two lateral sides of said housing.

38. An improved low profile electrical plug as set forth in claim 37, wherein said handle includes an arcuate portion curving away from the top face of said housing.

* * * * *